US005557991A

United States Patent [19]

Brodbeck

[11] Patent Number: 5,557,991

[45] Date of Patent: Sep. 24, 1996

[54] CALIBRATION HAND TOOL

[76] Inventor: James L. Brodbeck, 225 S. Ashford Pl., Fullerton, Calif. 92631

[21] Appl. No.: 410,080

[22] Filed: Mar. 24, 1995

[51] Int. Cl.[6] ..... B25B 17/00

[52] U.S. Cl. ..... 81/57.29; 81/60; 81/438

[58] Field of Search ..... 81/57.29, 57.28, 81/57.46, 58.1, 177.85, 437, 438, 439; 403/297

[56] References Cited

U.S. PATENT DOCUMENTS

| | | | |
|---|---|---|---|
| 1,645,570 | 10/1927 | Anderson | 81/57.29 |
| 2,483,563 | 10/1949 | Rock | 81/438 |
| 2,721,591 | 10/1955 | Criswell . | |
| 2,764,048 | 9/1956 | Thompson | 81/60 |
| 3,214,992 | 11/1965 | Dietrich | 81/57.29 |
| 3,315,545 | 4/1967 | Schnoebelen . | |
| 3,580,097 | 5/1971 | Van Dalen . | |
| 3,823,755 | 7/1974 | Sheffield . | |
| 3,992,964 | 11/1976 | Osmond . | |
| 4,048,874 | 9/1977 | Riches . | |
| 4,846,027 | 7/1989 | Lu . | |
| 5,033,336 | 7/1991 | Chia-Tsai . | |
| 5,289,743 | 3/1994 | Cirami . | |

FOREIGN PATENT DOCUMENTS

| | | | |
|---|---|---|---|
| 482193 | 4/1952 | Canada | 81/439 |

*Primary Examiner*—Willis Little

*Attorney, Agent, or Firm*—Knobbe, Martens, Olson & Bear

[57] ABSTRACT

An improved driving hand tool allows for precisely adjusting or calibrating small electronic or mechanical components. The tool may be used to adjust, for example, the resistance of a potentiometer, the frequency of a crystal oscillator, or the fuel flow rate of a carburetor. The tool includes a tumbler which drives a tool bit shaft through a reducing gearset. The gearset has a 90° shaft angle so that the tumbler rotates about an axis which is not parallel to the rotational axis of the tool bit. In this manner, rotation of the tumbler does not rotate the body of the tool which enables the tool to be held and operated easily with only one hand.

27 Claims, 4 Drawing Sheets

CALIBRATION HAND TOOL

BACKGROUND OF THE INVENTION

1. Field of the Invention

The present invention generally relates to a hand tool, and more particularly to a tool for making precise rotational adjustments to electrical or mechanical devices.

2. Description of Related Art

Many small electronic components, such as potentiometers or variable resistors, are adjusted by turning a tiny dial or screw. The dial typically includes an exposed slot or socket which receives the end of a common flat-blade jeweler's screwdriver or similar driving tool to rotate the dial. Turning the dial commonly changes the resistance of a potentiometer, or tunes the frequency of a crystal oscillator.

In the past, adjustment dials on such electronic components commonly were "multi-turn" dials. It required several complete revolutions of the dial to traverse the complete range of adjustability of the component. For instance, the range of adjustment of 1 to 60 ohms resistance in a potentiometer would correspond to three complete turns of the adjustment dial. Small movements of the multi-turn dial produce small changes in the component's characteristics, and large changes require several complete turns. Multi-turn dials thus generally are easily adjusted using a common jeweler's screwdriver.

The present trend in the electronics industry toward smaller electronic components, however, has made the multi-turn dial less attractive. Multi-turn dials require more complex mechanisms than single-turn dials, and thus cannot be packaged as compactly as the single-turn dial components. The direction in the electronics industry thus appears headed toward single-turn adjustment dials.

A single-turn dial spans the complete range of a component's electronic characteristics in a single revolution, and small movement of the dial produces large changes in the electronic characteristic (e.g., resistance) in the component. As a result, it is very difficult to adjust a single-turn components by hand using a screwdriver.

Several prior screwdrivers have been developed to assist technicians to adjust or assemble small electronic and mechanical components. Such tool have commonly included a handle and driving blade similar to that of a common screwdriver. Unlike a conventional screwdriver, however, a portion of the handle function as a tumbler that is coupled to the blade via a reducing gearset (e.g., a planetary gearset). U.S. Pat. No. 4,048,874 issued to Riches discloses an example of a prior screwdriver.

Although these types of screwdrivers reduce the rotation of the blade relative to the rotation of the handle tumbler, such screwdrivers tend to be difficult to use. Because of the commonly co-axial location and orientation between the handle tumbler and the tool blade, such devices generally must be used with two hands: one hand to hold steady the handle, and the other to rotate the tumbler. The user must hold the tool steady because the gear friction commonly is greater than the friction in the dial or screw of the electrical or mechanical device being adjusted. Using two hands, however, commonly obscures the work area from view. It also inhibits use of the tool in confined areas.

In addition, such tools tend to be overly complicated, involving complex gear trains. For instance, the screwdriver disclosed by U.S. Pat. No. 4,048,874 teaches the use of a planetary gear train to reduce the rotation speed of the screwdriver blade relative to the rotation of the handle tumbler. The complex structure of prior designs make such tools expensive and prone to breakage.

SUMMARY OF THE INVENTION

A need therefore exists for a simply structured hand tool that can accurately adjust dial of small electronic components, or loosen or tighten small fasteners, and that can be used easily with one hand, in cramped working conditions.

In accordance with one aspect of the present invention, an improved driving hand tool allows for precisely adjusting or calibrating small electronic or mechanical components. The tool may be used to adjust, for example, the resistance of a potentiometer, the frequency of a crystal oscillator, or the fuel flow rate of a carburetor.

The hand tool includes a drive shaft which rotates around a first axis, and a driving tumbler. The driving tumbler rotates about a second axis which extends in a nonparallel direction relative to the first axis. A gear train couples the driving tumbler and the driven shaft together. The drive train is configured to transmit rotational motion of the tumbler about the second axis into rotation of the shaft about the first axis. The drive train also reduces the rotational speed of the driven shaft relative to the driving tumbler.

Another aspect of the present invention involves a hand tool for making precise rotational adjustments of electrical or mechanical devices. The hand tool includes an elongated handle which is configured to be cradled between the thumb and finger of the user. The handle supports a rotatable shaft which rotates about a first axis, and a tumbler which rotates about a second axis. The second axis is generally normal to the first axis. The handle supports the tumbler in a position where the user can easily rotate the tumbler with the index finger while cradling the handle between the thumb and middle or ring finger. The tumbler is coupled to the shaft such that rotation of the tumbler about the second axis rotates the shaft about the first axis.

In accordance with an additional aspect of the present invention, a hand tool for making precise rotational adjustments of electrical or mechanical devices includes a driven shaft which rotates about a first axis. A driving tumbler rotates about a second axis which is generally nonparallel relative to the first axis. The tumbler is coupled to the shaft such that rotation of the tumbler about the second axis rotates the shaft about the first axis. The shaft includes a distal end which defines a receptacle that receives an end of a tool bit. The receptacle is formed by an elongated slot which extends into the shaft from a distal end, along a longitudinal axis of the shaft, to a proximal slot end. A relief of the receptacle is disposed between the shaft distal end and the proximal slot end and has a width which is greater than the slot. The relief is configured so as to receive a portion of the tool bit end.

BRIEF DESCRIPTION OF THE DRAWINGS

These and other features of the invention will now be described with reference to the drawings of preferred embodiments which are intended to illustrate and not to limit the invention, and in which.

DESCRIPTION OF THE PREFERRED EMBODIMENTS

Figure 1:
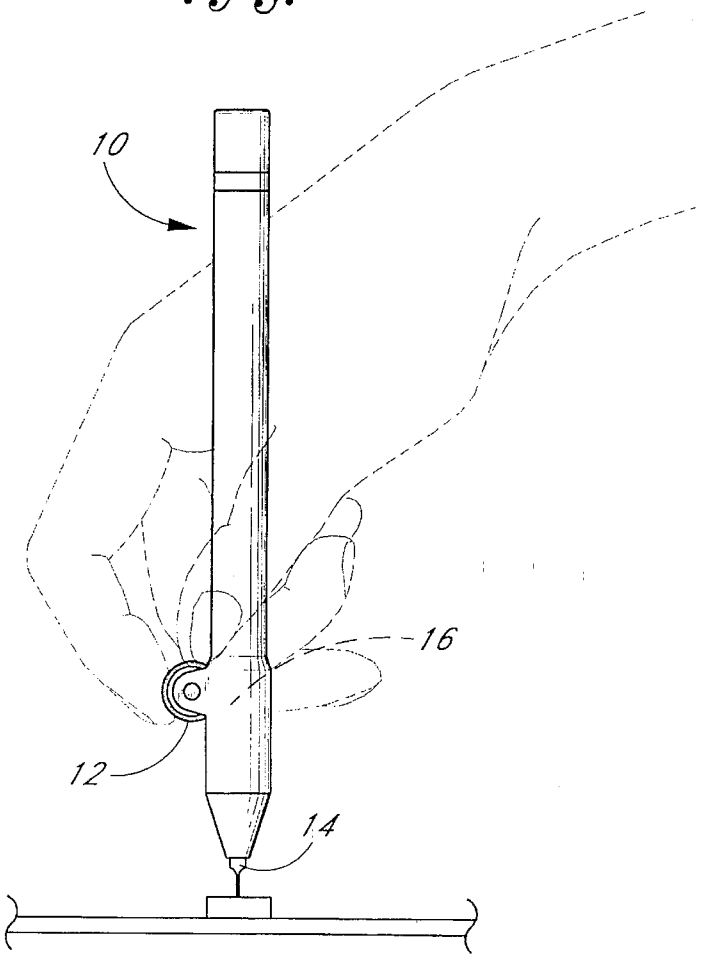
FIG. 1 is a side elevational view of a calibration tool configured in accordance with a preferred embodiment of the present invention, as properly held by a user.

FIG. 1 illustrates a calibration tool 10 which is configured in accordance with the preferred embodiment of the present invention. As seen in FIG. 1, the tool 10 generally has a scriber-like shape which is easily held between the thumb and middle finger of the user, in a manner similar to holding a pencil. The tool 10 also includes a tumbler 12 for rotating the tool bit 14 without rotating the body of the tool 10. The tumbler 12 desirably is positioned on the tool 10 in a location which is easily manipulated by the user's index finger when holding the tool 10 as described above. In the illustrated embodiment, the tumbler 12 is located proximate to the head of the tool, i.e., the end of the tool 10 which carries the tool bit 14.

The tool 10 includes a reducing gearset 16 formed in part by the tumbler 12. The reducing gearset 16, as described more fully below, causes the tool bit 14 to rotate at a fraction of the rotational displacement of the tumbler 12. The reduction in rotational displacement of the tool bit 14 relative to the rotation displacement of the tumbler 12 allows for finer adjustment and calibration than a conventional screwdriver. The frictional forces in the gearset 16, however, generally are greater than the frictional forces of the dial or screw of the electrical or mechanical component, which allows the tool bit 14 to rotate with the body of the tool 10 when rotated for coarse adjustment.

Figure 2:
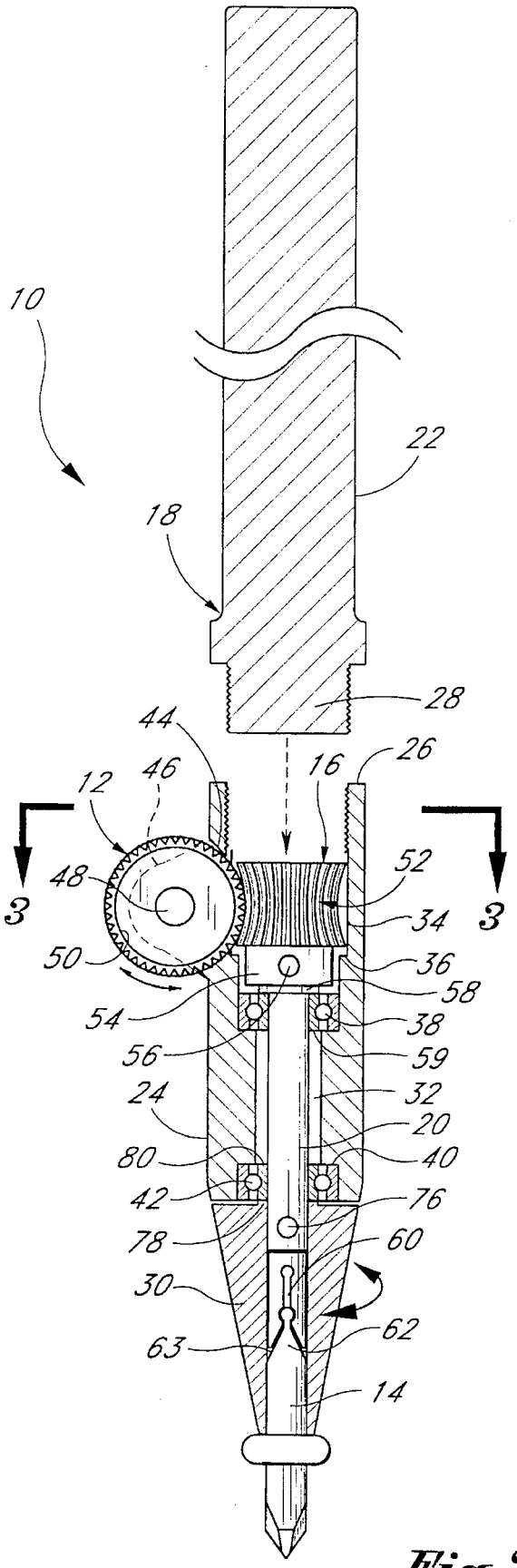
FIG. 2 is a sectional side elevation view of the calibration tool of FIG. 1.

FIG. 2 best illustrates the individual components of the tool 10. In connection with describing these individual components, the terms "proximal" and "distal" are used herein in reference to the palm of the users hand when holding the tool 10 as illustrated in FIG. 1. Thus, the tool bit 14 is located at the distal end of the tool 10.

The tool 10 includes a handle 18 which desirably has a cylindrical shape, although it may have flutes, ridges or knurls on its exterior in order to improve gripping by the user. The handle 18 is sized to be grasped easily by one hand, as shown in FIG. 1, and is made of any rigid, durable lightweight material such as metal (e.g., aluminum) or hard plastic (e.g., Delrin).

The handle 18 defines an internal cavity which houses the gearset 16 and a portion of a drive shaft 20. For this reason, the handle 18 preferably is formed in two parts: an proximal body 22 and a distal body 24. This two-part construction provides an easy means for assembling and disassembling the tool 10. Easy disassembly of the tool handle 18 is advantageous because the gearset 16 may occasionally need to be cleaned and oiled.

In the illustrated embodiment, the proximal body 22 desirably comprises a solid cylinder with an annular shoulder 26 formed proximate to its distal end. The distal end also includes a threaded shank 28 with a major diameter less than the diameter of the shoulder 26.

The distal body 24 generally has a cylindrical outer shape with a distal end which tapers toward the tool bit 14. The shape of the distal end conforms with the shape of an end cap 30 carried by the shaft 20, as described below. The distal body 24 can alternatively include a distal end which tapers to a narrow tip at which the distal body 24 has a diameter slightly larger than the shaft 20. With this design, the distal body 24 extends to a point proximate to the distal end of the tool bit 14, thus eliminating the end cap 30. In either case, the tapering distal shape of the tool handle 18 allows the tool 10 to be easily handled and does not obscure the work area when used.

The distal body 24 includes a central bore 32 which extends through the distal body 24 along the longitudinal axis of the tool 10. The central bore 32 opens into a counterbore 34 formed at a proximal end of the distal body 24. A proximal portion of the counterbore 34 carries internal threads which cooperate with the threaded shank 28 of the proximal body 22.

A distal portion of the counterbore 34 forms the internal cavity which houses the gearset 16. As seen in FIG. 2, the counterbore 34 is sized to receive a portion of the gearset 16 which freely operates within the counterbore 34. The threaded shank 28 of the proximal body 22 encloses the gearset 16 within the counterbore 34 when the threaded shank 34 is threaded into the proximal portion of the counterbore 34.

The counterbore 34 of the distal body 24 also houses a bearing assembly 38 which journals an upper end of the drive shaft 20 within the distal body 24. As seen in FIG. 2, the bearing 38 is seated at the distal end of the counterbore 34.

The distal body 24 also includes a second counterbore 40 which extends into the distal body 24 from its distal end. The second counterbore 40 forms a seat for a second bearing assembly 42 which journals a lower end of the shaft 20 within the handle 18.

Figure 3:
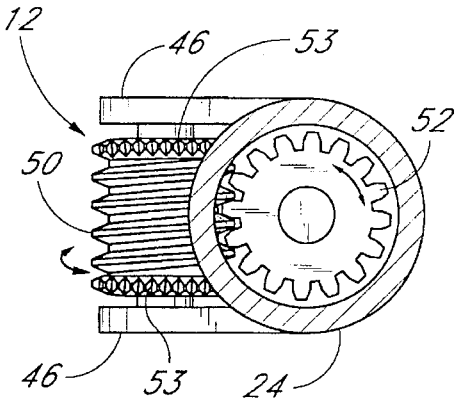
FIG. 3 is a cross-sectional view of the calibration tool of FIG. 2 taken along line 3—3.

As understood from FIGS. 2 and 3, an aperture 44 extends through the side of the distal housing 24 and opens into the counterbore 34. The aperture 44 has a sufficient size so as to receive a portion of the tumbler 12.

Two lugs 46 extend from the side of the lower body 24 on either side of the aperture 44. The lugs 46 rotatably support a tumbler 12 between them. In the illustrated embodiment, an axle 48 extends between the lugs 46 with the tumbler 12 supported on the axle 48.

In the illustrated embodiment, the tumbler 12 is located toward the upper end of the distal body 24, and rotates about an axis (i.e., the axis of the axle 48) which generally is perpendicular to the rotational axis of the shaft 20. As schematically illustrated in FIG. 1, a user can easily manipulate the tumbler 12 with his or her index finger with the tumbler 12 in this position.

Rotating the tumbler 12 at a right angle to the rotational axis of the shaft 20 provides a significant advantage in that the tool 10 is not twisted or torqued about that axis of the shaft 20 when rotating the tumbler 12. In prior tools, as discussed above, twisting the tumbler also tended to twist the tool and shaft as well, greatly reducing the precise functioning of the tool and requiring the tool to be held with one hand and operated with the other.

With reference to FIG. 2, the shaft 20 desirably has an elongated cylindrical shape and is journaled within the distal body 24 by the pair of bearings 38, 42. The bearings 38, 42 are located at the upper and lower ends of the central bore 32, as described above. The shaft 20 extends from the proximal counterbore 34, thought the central bore 32, and beyond the distal end of the distal housing 24. The shaft 20 desirably is positioned such that the longitudinal axis of the shaft 20 lies collinear with the longitudinal axis of the tool 10.

The reducing gearset 16 of the tool 10 interconnects the tumbler 12 to the shaft 20. The gearset 16 desirably is a right-angled (i.e., 90° shaft angle) gearset, so that the input of the tumbler 12 is transmitted, through a right angle turn, directly to the shaft 20. In other words, rotation of the tumbler 12 about a first axis (i.e., the axis of the axle 48) is transmitted to drive the shaft 20 to rotate about a second axis (i.e., the longitudinal axis of the shaft 20).

In the illustrated embodiment of FIGS. 2 and 3, the gearset 16 is formed by a driving worm 50 and a driven worm gear 52. As best seen in FIG. 3, the worm 50 is formed on the tumbler 12, and the worm gear 52 is carried by the drive shaft 20. Integrating the worm 50 into the tumbler 12 provides a simple and elegant mechanism for simultaneously reducing the ratio of rotation between the tumbler 12 and the shaft 20, and transmitting the rotational movement of the tumbler 12 to the shaft 20 through 90 degrees. The tumbler 12 desirably includes a pair of knurled ends 53 with the threads of the worm 50 formed therebetween. The knurled ends 53 improve the contact between the user's finger and the tumbler 12.

As seen in FIGS. 2 and 3, a portion of the worm 50 which extends through the aperture 44 in the distal body 24 and meshes with the worm gear 52. The worm 50 and worm gear 52 are held in mesh engagement such that rotation of the worm 50 about a first axis (e.g., about the axis of the axle 48) drives the worm gear 52 about a generally perpendicular second axis (e.g., the axis of the shaft 20).

As seen in FIG. 2, the drive shaft 20 carries the worm gear 52 at its upper end. The worm gear 52 includes a pin hub 54 which includes a central hole that receives the upper end of the shaft 20. A pin or set screw 56 secures the worm gear 52 onto the upper end of the shaft 20 in a known manner.

The worm gear 52 also includes a bushing 58 below the pin hub 54. The lower bushing 58 desirably has a diameter smaller than the diameter of the pin hub 54 and preferably equal to the diameter of an inner race 59 of the upper bearing assembly 38. The central hole of the worm gear 52 also extends through the lower bushing 58 to allow the worm gear 52 to be positioned over the proximal end of the shaft 20.

As seen in FIG. 2, the worm gear 52 is captured within the internal cavity of the distal body 24 when the tool 10 is assembled. The proximal end of the worm gear 52 lies just below the distal end, of the threaded shank 28, but does not contact the distal end of the shank 28 when rotated. The lower bushing 58 rests on the inner race 59 of the upper bearing assembly 38.

The worm/worm gear gearset 16 reduces the rotation ratio between the rotational movement input by the tumbler 12 and the output rotational movement transmitted to the shaft 20, in a very small space. The worm 50 and worm gear 52 desirably are selected to provide an input-to-output rotational ratio (i.e., gear ratio) of about 16:1 or greater, and more preferably 20:1 or greater. This ratio allows extremely fine adjustment of electronic or mechanical components to be easily made by hand. Of course, the gear ratio of the gearset 16 can be selected at any ratio in order to suit a specific application. A ratio as low as 2:1 or as high as 60:1 or greater can be used equally well with the present tool 10, provided that the ratio is selected to suit the intended use of the tool 10.

The worm gear 52 will not easily back-drive the worm 50, however; and thus the worm 50 will not turn if torque is applied to the shaft 20 and/or the worm gear 52. The tool 10 thus can be used like a conventional screwdriver and rotated by the handle 18 to tighten a screw or to coarsely adjust an electrical or mechanical device.

The worm/worm gear gearset 16 also desirably has minimal backlash; that is, there is very little slop in the gearset 16 when it is not moving or when reversing the direction of rotation. This low backlash characteristic of the gearset 16 enhances the accuracy of the tool 10 when making fine adjustments.

The present tool 10 desirably can be used with several different types or styles of dials, slots, sockets, or fasteners. For this purpose the tool 10 is adapted to be used with several different types of interchangeable tool bits 14, which are described below.

With reference to FIG. 2, the shaft 20 in the illustrated embodiment terminates in a socket 60 which is configured to releasable receive a proximal end of a tool bit 14. The distal end of the shaft 20, however, can of course be formed in the shape of a specific tool head, such as, for example, a flat blade, Phillips head, hex, star, or like socket.

Figure 4:
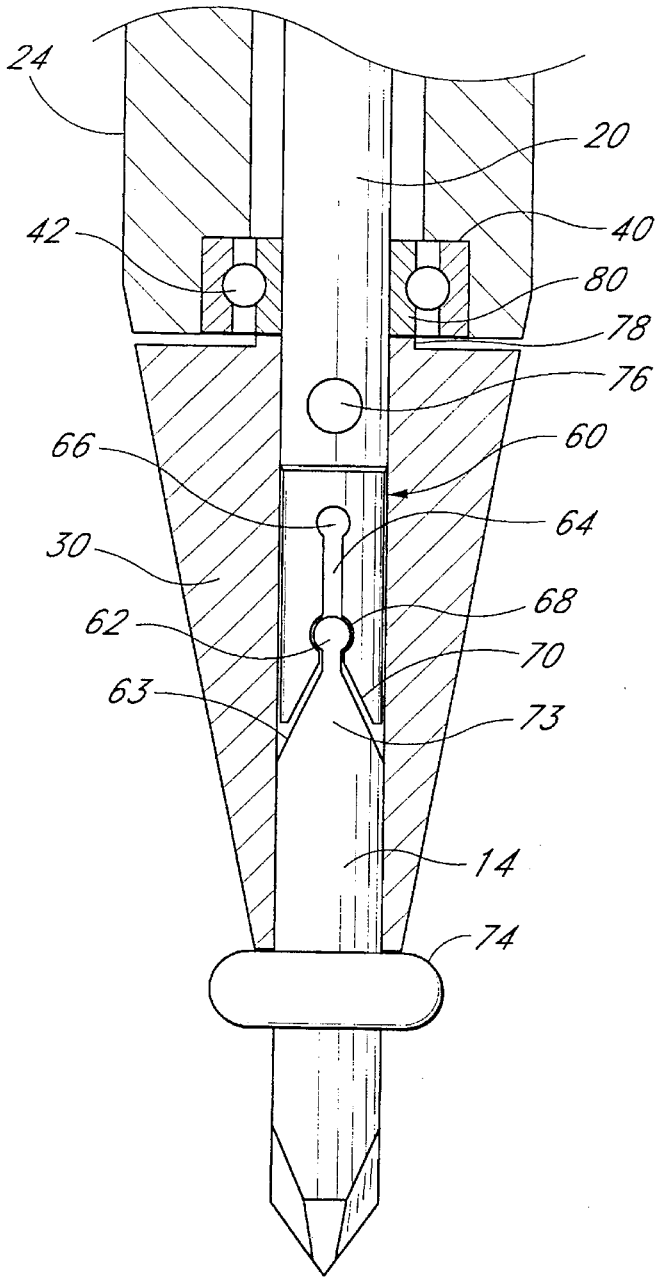
FIG. 4 is an enlarged, partially sectioned, side elevational view of a head of the calibration tool of FIG. 2.

FIG. 4 best illustrates the resilient socket 60 at the distal end of the shaft 20. The socket 60 accepts a mating plug 62 from any of several interchangeable bits 14, which will be described later. The socket 60 is preferably formed at the distal end of the shaft 20, which is slightly turned down (i.e., reducing its diameter). This allows the socket 60 to expand within the bore 63 of the end cap 30 when the plug 62 of a bit 14 is inserted into the socket 60.

The socket 60 includes a slot 64 cut into the distal end of the shaft 20, as shown in FIG. 4. The slot 60 desirably extends along the axis of the shaft 20. This slot 64 includes a rounded upper end 66, which has a diameter larger than the width of the slot 64 to prevent stress concentration in the upper end of the slot 64 as the slot 64 is flexed open.

A recess 68 is formed toward the distal end of the socket 60. The recess 68 is of a size and shape so as to firmly retain the plug 62 of an interchangeable bit 14. The recess 68 also is sized and shaped to prevent the plug 62 from pulling out under mild tension, yet allow the plug 62 to release from the socket 60 if the bit 14 is firmly pulled distally. In the illustrated embodiment of FIG. 4, the recess 68 desirably has a cylindrical shape which cooperates with the plug 62. The slot 64 and recess 66, 68 of the socket 60 can be formed in any of a variety of ways known in the art, including wire EDM.

The distal end of the socket 60 includes a tapered section 70 to assist insert the plug 62 into the recess 68 of the slot 60. The tapered section 70 generally has a V-shape which tapers in the distal-to-proximate direction from about the diameter of the turn-down distal end of the shaft 20 to the width of the slot 64. As seen in FIG. 4, the proximal end of the tapered section 70 lies just distal of the recess 68 of the slot 60.

Figure 5:
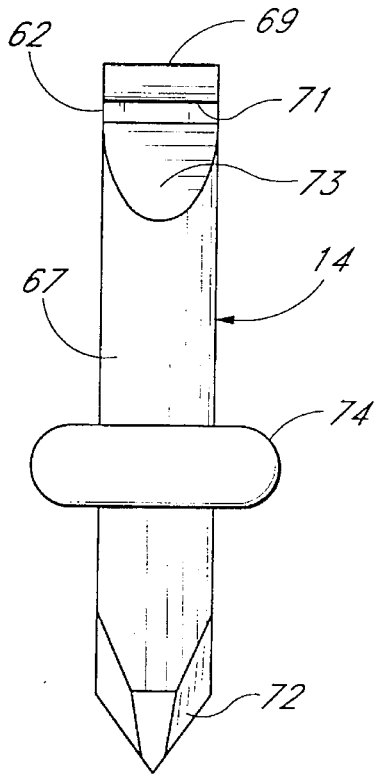
FIG. 5 is an enlarged side elevational view of a tool bit of the calibration tool of FIG. 2.

FIG. 5 illustrates an exemplary interchangeable tool bit 14. The tool bit 14 includes a cylindrical body 67 of a diameter generally equal to that of the shaft 20 and slightly smaller than the bore 63 of the end cap 30. The body 67 terminates in the plug 62 at its proximal end and a tool head 72 at its distal end.

The distal head 72 of the tool bit 14 may be configured as a flat-blade head, as shown in FIG. 1, or a Phillips head as shown in FIGS. 2 and 4. Of course, the tool bit 14 also can have any of a number of a variety of tool head configurations, such as, for example, Allen or star heads. The head 72 of the tool bit 14 also can be configured as a socket for receiving nuts or similarly shaped fasteners, disks, knobs or the like.

As seen in FIG. 5, the plug 62, like the socket 60, has a cylindrically shaped head 69 supported by a section 71. The cylindrical head 69 has a diameter which generally equals the diameter of the recess 68 of the slot 60. The neck section 71 has a width which is slightly less than the width of the slot 64. The neck section 71 has a length, measured in the axial direction, which generally equals the distance between the recess 68 and the tapered section 70 of the socket 60. The width of the plug 62 allows the shaft 20 to apply a torque on the tool bit 14 through the socket 60/plug 62 interconnection.

With reference to FIGS. 4 and 5, the neck section 71 of the plug 62 transitions into a tapered section 73 of the tool bit 14. The tapered section 73 generally has a V-shaped profile, as seen in FIG. 4, and forms a transition between the diameter of the cylindrical body 67 and the neck section 71 of the plug 62. The tapering shape of the tapered section 73 of the tool bit 14 generally has a shape which matches the tapered section 70 of the socket 60, such that when the plug 62 is inserted into the socket 60, the tapered sections 70, 73 engage. FIG. 4 illustrates a gap between these tapering sections 70, 73 in order to differentiate the tool bit 14 from the distal end of the shaft 20; however, it is desired that the corresponding tapering sections 70, 73 of the socket 60 and the tool bit 14, respectively, engage each other when the plug 62 is inserted into the socket 60. The socket 60 thus snugly receives the plug 62 of the tool bit 14.

Although the socket 60 and the corresponding plug 62 have been described in terms of a certain preferred shape, it is contemplated that the socket 60 and the plug 62 can have a variety of other shapes which will be apparent to those skilled in the art. The socket 60 and the plug 62 need only provide a releasable connection between the tool bit 14 and the shaft, which couples the tool bit 14 to the shaft in a manner causing the tool bit 14 to rotate with the shaft 20. That is, the connection between the socket 60 and the plug 62 must transmit rotational torque from the shaft 20 to the tool bit 14.

Each tool bit 14 also desirably includes a pull ring 74 to assist inserting the bit 14 into and removing the bit 14 from the tool 10. The pull ring 74 can be made of metal and integrally formed with the bit 14, or it can be a rubber or plastic ring which is bonded to the bit 14 with a suitable adhesive. The pull ring also can be an O-ring which sits within a groove (not shown) that circumscribes the bit 14 at about its midsection. As seen in FIG. 4, the pull ring 74 has a diameter larger than the diameter of the distal end of the housing 18 or the end cap 30. A user thus can easily grasp the pull ring 74 to pull the tool bit 14 from the socket 60.

With reference to FIG. 2, the distal end of the shaft 20 carries the end cap 30. Specifically, the end cap is mounted to the distal end above the socket 60. In the illustrated embodiment, a pin 76 secures the end cap 30 to the shaft 20. Of course, the end cap may be secured to the shaft 20 by any of a variety of known means, such as, for example, using adhesive, a set screw, or like means.

In the illustrated embodiment, the end cap 30 has a generally conical shape, with its proximal end having a diameter about equal to the diameter of the distal end of the distal body 24. The distal end of the end cap 30 has a diameter about equal to the diameter of the shaft 20. The end cap 30 also includes the central bore 63 which has a diameter slightly larger than the diameter of the shaft 20 and tool bit 14 so that the proximal end of the end cap 30 can fit over the shaft 20 and the tool bit 14 can be inserted into the distal end of the end cap 30 so as to engage the socket 60. The axis of the bore 63 desirably lies collinear with the axis of the central bore 32 of the distal body 24.

The end cap 30 also includes an annular collar 78 which circumscribes the central bore 63. The annular collar 78 has an outer diameter which generally matches the diameter of an inner race 80 of the lower bearing assembly 42. The annular collar 78 sits on the inner race 80 when assembled.

The distance between the distal end of the distal body 24 to the lower pin hole in the shaft 20 is slightly less than the distance between the corresponding pin hole in the end cap 30 and the proximal end of the annular collar 78. As such, when the end cap 30 is attached to the shaft 20 by inserting the pin 76 through the corresponding holes in the end cap 30 and the shaft 20, the shaft 20 is placed in tension. That is, the shaft 20 is preloaded to pull the lower bushing 58 of the worm gear 50 against the inner race 59 of the upper bearing assembly 38, and to pull the annular collar 78 of the end cap 30 against the inner race 80 of the lower bearing assembly 42. The preload in the shaft 20 takes up any slop within the gearset 16 to generally prevent axial movement of the shaft 20. In addition, rotational friction between the handle 18 and the shaft 20, worm gear 50 and end cap 30 is minimized by loading the worm gear 50 and the end cap 30 onto the corresponding inner races of the respective bearing assemblies 38, 42.

To use the tool 10, a user first installs a tool bit 14 in the socket 60. This is done by inserting the plug 62 of the bit 14 into the slot 60, until the plug 62 is firmly seated within the socket 60.

Holding the tool 10 in one hand, as shown in FIG. 1, the user rotates the tumbler 12 with his or her finger. The rotation of the tumbler 12/worm 50 drives the worm gear 52 which turns the shaft 20, the socket 60, and the tool bit 14. In a preferred embodiment, twenty complete turns of the tumbler 12 will produce one complete revolution of the tool bit 14.

The present tool 10 therefore allows one to finely adjust electrical or mechanical components with large input motions. That is, large rotational displacement on the tumbler 12 results in minimal rotation of the tool bit 14 so as to make fine adjustments easier. The present tool 10 also is easily held and operated with one hand, which allows the tool to be used in confined spaces. Rotating the tumbler 12 about a nonparallel axis to the rotational axis of the tool bit 14 does not twist or torque the handle 18. In addition, the ergonomic placement of the tumbler 12 on the handle 18 allows one to easily operate the tool 10 while holding the tool in the familiar manner of holding a pen or pencil. And, as mentioned above, the present tool 10 also can be used as a conventional driver (e.g., screwdriver) by turning the handle 18.

As understood from the above, the present tool 10 has a simple structure, yet achieves the aforementioned advantages over prior reduction screwdrivers. The simple structure of the present tool 10 thus is less expensive to produce and is less likely to require servicing or replacement.

Figure 6:
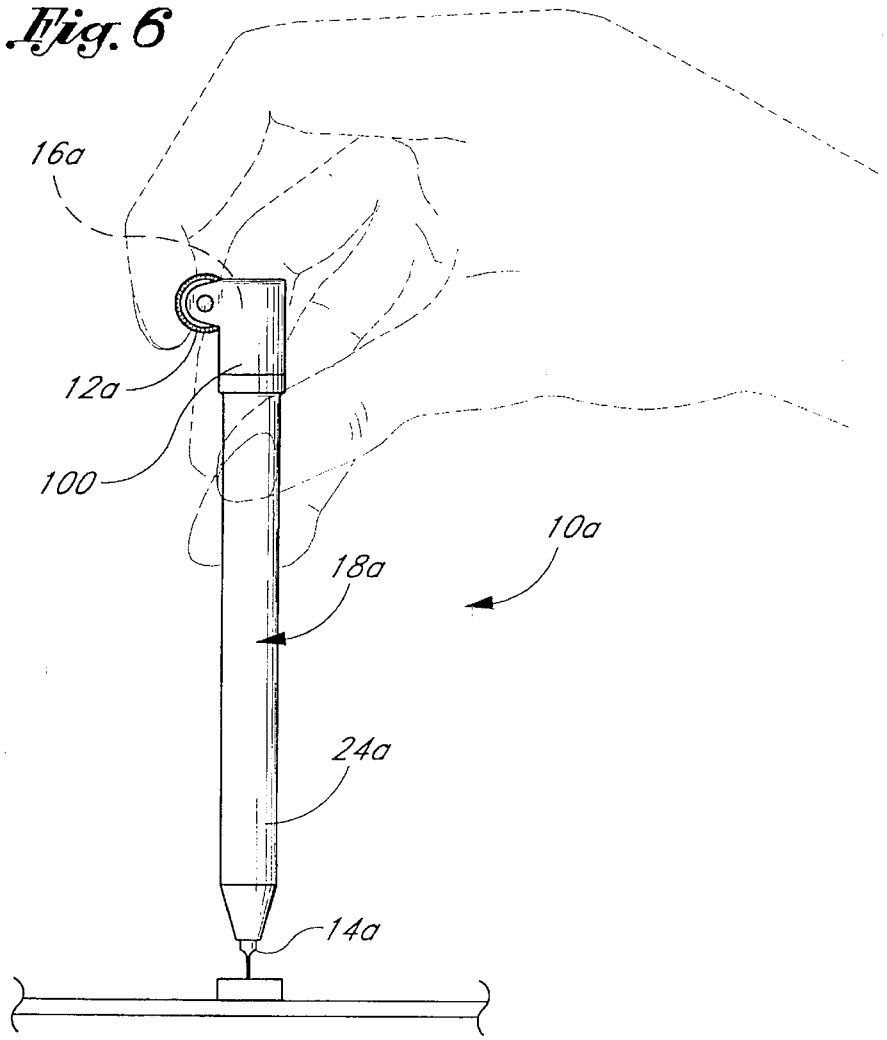
FIG. 6 is a side elevational view of a calibration tool configured in accordance with another preferred embodiment of the present invention, as properly held by a user.
Figure 7:
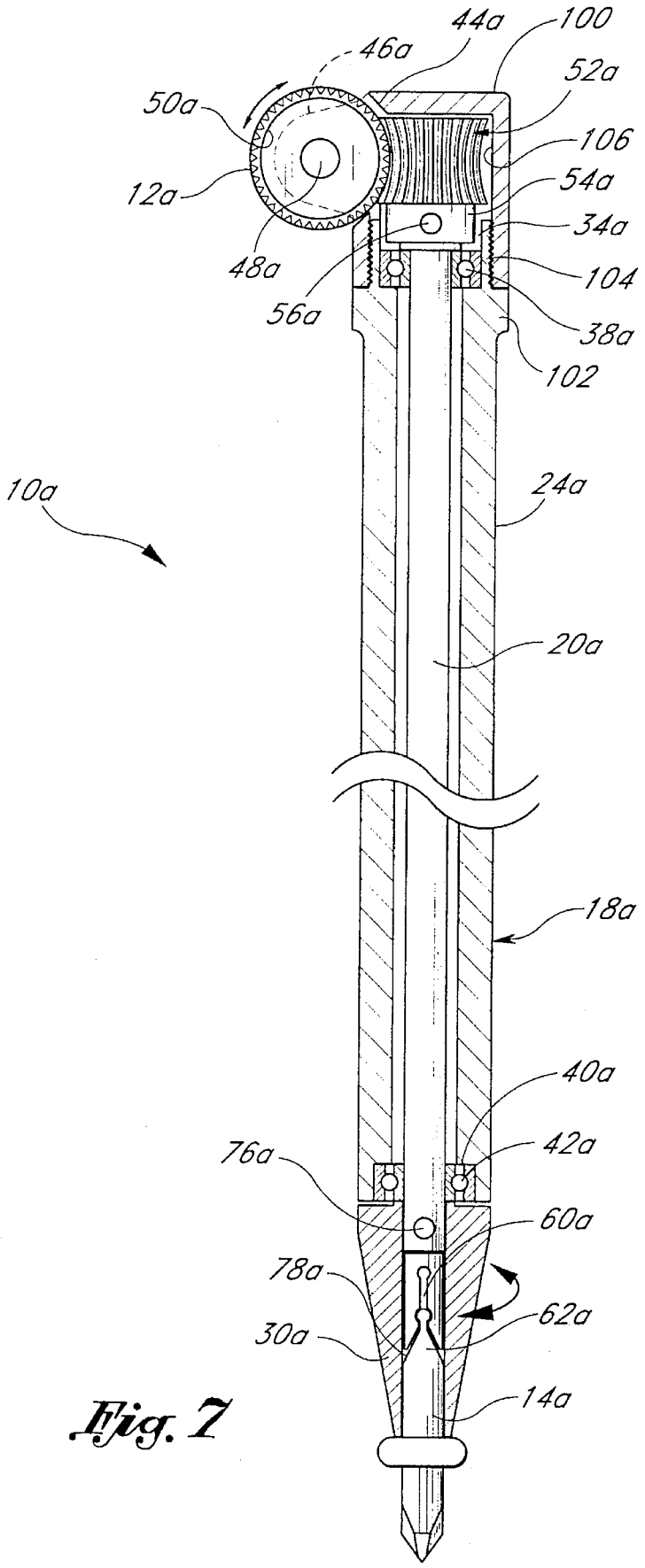
FIG. 7 is a sectional, side elevation view of the calibration tool of FIG. 6.

FIGS. 6 and 7 illustrate a calibration tool 10*a*, which is configured in accordance with another preferred embodiment of the present invention. Where appropriate, like reference numerals with an "a" suffix have been used to indicate like components of the two embodiments for ease of understanding.

As seen in FIG. 2, the tool 10*a* generally has a scriber-like shape which is easily held between the thumb and the middle and/or ring finger of the user, with the user's index finger positioned on top of the calibration tool 10*a*. The tool 10*a* also includes a tumbler 12*a* for rotating the tool bit 14*a* without rotating the body of the tool 10*a*. The tumbler desirably is positioned on the tool 10*a* in a location which is easily manipulated by the user's index finger which rests at the top of the calibration tool 10*a*. In the illustrated embodiment, the tumbler is located at the proximal end of the tool 10*a*.

As with the above-described embodiment, the present tool 10*a* includes a reducing gearset 16*a* formed in part by the tumbler 12*a*. The reducing gear set 16*a* causes the tool bit 14*a* to rotate at a fraction of the rotational degree of the tumbler 12*a*.

The tool 10*a* includes a handle 18*a* which desirably has a cylindrical shape and is sized to be grasped easily by one hand, as shown in FIG. 6. The handle 18*a* is made of any rigid, durable, lightweight material such as metal (e.g., aluminum) or hard plastic (e.g., Delrin). The handle 18*a* defines an internal cavity which houses the gearset 16*a* and a portion of the drive shaft 20*a*. For this reason, the handle 18*a* preferably is formed in two parts: a proximal end cap 100 and a distal body 24*a*.

As seen in FIG. 7, the distal body 24*a* generally has a tubular shape with an inner diameter sized to receive the shaft 20*a*. The outer diameter of the cylindrical distal body 24*a* is sized so as to be comfortably held between the fingers of the user, as illustrated in FIG. 6.

In the illustrated embodiment, the distal body 24*a* is also configured to cooperate with an end cap 30*a* of the tool 10*a*. It is contemplated, however, that the distal body 24*a* alternatively can include a distal end which tapers to a narrow tip at which the distal body 24*a* has a diameter slightly larger than the shaft 20*a*. With this design the distal body 24*a* extends to a point proximate to the head of the tool bit 14*a*, thus eliminating the end cap 30*a*. In either case the tapering distal shape of the tool handle 18*a* allows the tool 10*a* to be easily handled and does not obscure the work area when used.

The proximal end of the distal body 24*a* includes an annular shoulder 102. An externally threaded shank 104 extends in the proximal direction from the annular shoulder 102. The shank 104 has a major diameter which is less than the diameter of the annular shoulder 102.

As seen in FIG. 7, the proximal end of the distal body 24*a* also includes a counterbore 34*a* which forms part of the internal cavity. The counterbore 34*a* also houses a bearing assembly 38*a* which journals an upper end of the drive shaft 20*a* within the distal body 24*a*. As seen in FIG. 7, the bearing 38*a* is seated at the distal end of the counterbore 34*a*.

The distal body 24*a* also includes a second counterbore 40*a* which extends into the distal body 24*a* from its distal end. The second counterbore 40*a* forms a seat for a second bearing assembly 42*a*, which journals a lower end of the shaft 20*a* within the handle 18*a*.

The upper end cap 100 has a cylindrical outer shape of a diameter which generally matches the diameter of the annular shoulder 102 of the distal body 24*a*. The upper end cap 100 includes a central bore 106 which extends into the end cap 100 from the distal end. The proximal end of the end cap 100 is closed. Internal threads are formed at the distal end of the central bore 106 of the end cap 100. The internal threads are configured to cooperate with the external threads on the distal shank 104 of the distal body 24*a*.

The central bore 106 of the upper end cap 100 cooperates with the counterbore 34*a* of the distal body 24*a* to form the inner cavity which houses the gearset 16*a*. As understood from FIG. 7, an aperture 44*a* extends through the side of the upper end cap 100 and opens into the central bore 106 of the upper end cap 100. The aperture 44*a* has a sufficient size so as to receive a portion of the tumbler 12*a*.

A pair of lugs 46*a* extend from the side of the upper end cap 100 on either side of the aperture 44*a*. The lugs 46*a* rotatably support the tumbler 12*a* between them. In the illustrated embodiment, an axle 48*a* extends between the lugs 46*a*, with the tumbler 12*a* supported on the axle 48*a*.

In the illustrated embodiment, the tumbler 12*a* is located at the proximal end of the handle 18*a* and rotates about an axis (i.e., the axis of the axle 48*a*), which generally is perpendicular to the rotational axis of a shaft 20*a*. As schematically illustrated in FIG. 6, a user can easily manipulate the tumbler 12*a* with his or her index finger, with the user gripping the tool 10*a* between the thumb, index finger, and ring finger. As with the above embodiment, rotating a tumbler 12*a* at a right angle to the rotational axis of the shaft 20*a* provides a significant advantage in that the tool 10*a* is not twisted or torqued about the axis of the shaft 20*a* when rotating the tumbler 12*a*.

The reducing gearset 16*a* of the tool 10*a* connects the tumbler 12*a* to the shaft 20*a* in a manner similar to that described above in connection with the above embodiment. As such, the shaft 20 end and the reducing gearset 16*a* desirably are configured in accordance with the above description, and a further description of these components is not believed necessary for an understanding of the present embodiment.

In addition, the present embodiment of the hand tool 10*a* similarly includes an interchangeable tool bit 14*a*. For this purpose, the present tool 10*a* includes a socket 60*a* at the end of the shaft 20*a* which is configured in accordance with the above description. The tool bit 14*a* similarly is configured in accordance with that described above. Again, further descriptions of these features are not believed necessary in view of the foregoing description.

To use the tool 10*a*, a user inserts a tool bit 14*a* into the distal end of the tool until the tool bit engages the socket 60*a*. The releasable interconnection between the socket 60*a* and the tool bit 14*a* securely holds the tool bit 14*a* onto the end of the shaft 20*a* and allows the tool bit 14*a* to rotate with the shaft 20*a*. The user grips the tool 10*a* between the thumb and at least the middle or ring finger. The user then positions the index finger on top of the end cap 100 so as to steady the tool 10*a*. In this position the user can also manipulate the tumbler 12*a* to rotate the tool bit 14*a*. Specifically, the rotation of the tumbler 12*a* drives the worm gear 52*a*, which turns the shaft 20*a*, the socket 60*a*, and the tool bit 14*a*. As with the abovedescribed embodiment, multiple turns of the tumbler 12*a* are required to complete one revolution of the tool bit 14*a* to facilitate fine adjustment of mechanical or electrical components.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A hand tool for making precise rotational adjustments of electrical or mechanical devices, said hand tool comprising:

a driven shaft which rotates about a first axis;

a handle in which at least a portion of said driven shaft is journaled;

a driving tumbler which rotates about a second axis which extends in a nonparallel direction relative to said first axis, said tumbler supported by said handle in a position where at least a portion of said tumbler is exposed generally at a point of intersection between said second axis and a line which extends between said first and second axes, said line being substantially perpendicular to both said first and second axes; and a gear train which couples together said driving tumbler and said driven shaft, said gear train configured to transmit rotational motion of said tumbler about said second axis into rotation of said shaft about said first axis and to reduce the rotational speed of said driven shaft relative to said driving tumbler.

2. The hand tool of claim 1, wherein said second axis is generally perpendicular to said first axis.

3. The hand tool of claim 1, wherein said gear train comprises a gearset formed by a driving gear which is coupled to said tumbler and a driven gear which is coupled to said shaft.

4. The hand tool of claim 3, wherein said gearset has a gear ratio of 16 to 1 or greater.

5. The hand tool of claim 4, wherein said gearset has a gear ratio of 20 to 1.

6. The hand tool of claim 3, wherein said driving gear comprises a worm and said driven gear comprises a worm gear.

7. The hand tool of claim 6, wherein said tumbler and said driving worm are integrally formed with at least a portion of said driving worm being formed on said exposed portion of said tumbler.

8. The hand tool of claim 6, wherein said shaft includes a proximal end and a distal end, and carries said worm gear at said proximal end.

9. The hand tool of claim 8, wherein said distal end of said driven shaft defines a receptacle which is configured to accept and releasable retain a proximal end of a tool bit of said hand tool.

10. The hand tool of claim 9, wherein said tool bit includes a distal tool end which is configured to engage a portion of the electrical or mechanical device.

11. The hand tool of claim 1, wherein said handle has an elongated shape with a longitudinal axis defined between proximal and distal ends, said longitudinal axis being generally collinear with said first axis.

12. The hand tool of claim 6, wherein said driving worm is integrally formed with at least a portion of said tumbler.

13. The hand tool of claim 1, wherein said handle includes a proximal end and a distal end, and said tumbler is disposed on said handle at a position proximate to said proximal end of said handle.

14. The hand tool of claim 1, wherein said hand tool includes a proximal end and a distal end, and said tumbler is attached to said handle at a position proximate to said distal end of said hand tool.

15. A hand tool for making precise rotational adjustments of electrical or mechanical devices, said hand tool including a proximal end and a distal end and comprising a driven shaft which rotates about a first axis, a driving tumbler which rotates about a second axis which extends in a nonparallel direction relative to said first axis, a gear train which couples together said driving tumbler and said driven shaft, said gear train configured to transmit rotational motion of said tumbler about said second axis into rotation of said shaft about said first axis and to reduce the rotational speed of said driven shaft relative to said driving tumbler, and a handle in which at least a portion of said driven shaft is journaled, said tumbler being attached to said handle in a position where at least a portion of said tumbler is exposed at a position proximate to said proximal end of said hand tool.

16. The hand tool of claim 15, wherein said gear train comprises a gearset formed by a driving worm which is coupled to said tumbler and a driven worm gear which is coupled to said shaft.

17. The hand tool of claim 16, wherein said tumbler and said driving worm are integrally formed with at least a portion of said driving worm being formed on said exposed portion of said tumbler.

18. The hand tool of claim 15, wherein said driven shaft includes a distal end including a receptacle with is configured to releasably receive a portion of a tool bit of said hand tool.

19. A hand tool for making precise rotational adjustments of electrical or mechanical devices, said hand tool comprising an elongated handle which is configured to be cradled between the thumb and a first finger of the user, said handle supporting a rotatable shaft which rotates about a first axis and a tumbler which rotates about a second axis, said second axis being generally normal to said first axis, said handle supporting said tumbler in a position where the user can easily rotate said tumbler with a second finger while cradling said handle between the thumb and said first finger, said tumbler coupled to said shaft such that rotation of said tumbler about said second axis rotates said shaft about said first axis.

20. The hand tool of claim 19 additionally comprising a gear train which couples together said tumbler and said shaft, said gear train configured to reduce the rotational speed of said shaft relative to rotation of said tumbler.

21. The hand tool of claim 20, wherein said gear train has a gear ratio of 20 to 1.

22. The hand tool of claim 20, wherein said gear train is formed by a driving worm and a driven worm gear, said worm being integrally formed with said tumbler and said worm gear being carried by said shaft.

23. The hand tool of claim 19, wherein said handle supports said tumbler at a location proximate to a distal end of said shaft.

24. A hand tool for making precise rotational adjustments of electrical or mechanical devices, said hand tool comprising a driven shaft which rotates about a first axis, and a driving tumbler which rotates about a second axis which extends in a nonparallel direction relative to said first axis, said tumbler coupled to said shaft such that rotation of said tumbler about said second axis rotates said shaft about said first axis, said shaft including a distal end which defines a receptacle to receive an end of a tool bit, said receptacle comprising an elongated slot which extends into said shaft from said distal end of said shaft, along a longitudinal axis of said shaft, and to a proximal slot end, and a relief which is configured to receive a portion of the tool bit end and is disposed between said shaft distal end and said proximal slot end and having a width greater than said slot.

25. The hand tool of claim 24, wherein said relief of said tool bit receptacle has a bulbous shape.

26. The hand tool of claim 24, wherein said proximal slot end has a bulbous shape of a width greater than the width of said slot.

27. The hand tool of claim 24 additionally comprising a gearset which interconnects said tumbler and said shaft, said gearset comprising a worm integrally formed with said tumbler and a worm gear carried by said shaft proximate to a proximal end of said shaft.

* * * * *